US006604285B2

(12) United States Patent
Burdgick

(10) Patent No.: US 6,604,285 B2
(45) Date of Patent: Aug. 12, 2003

(54) METHOD AND APPARATUS FOR ELECTRONICALLY DETERMINING NOZZLE THROAT AREA AND HARMONICS

(75) Inventor: Steven S Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 162 days.

(21) Appl. No.: 09/875,268

(22) Filed: Jun. 7, 2001

(65) Prior Publication Data

US 2002/0193897 A1 Dec. 19, 2002

(51) Int. Cl.[7] ..... B23P 15/00

(52) U.S. Cl. ..... 29/889.22; 29/889.21; 29/407.04; 29/407.05; 33/565

(58) Field of Search ..... 700/97; 703/7; 33/700, 701, 504, 505, 553, 554, 565; 29/889.22, 889.21, 407.04, 407.05; 73/826.9; 702/150, 152, 156

(56) References Cited

U.S. PATENT DOCUMENTS 4,327,495 A * 5/1982 Plante ..... 29/889.22
4,811,253 A * 3/1989 Johns ..... 702/168
4,887,231 A * 12/1989 Ratliff et al. ..... 702/156
5,174,715 A * 12/1992 Martin ..... 415/209.4
5,182,855 A * 2/1993 Martin ..... 29/889.22
5,261,229 A * 11/1993 Ford et al. ..... 60/262
5,521,847 A * 5/1996 Ostrowski et al. ..... 702/152
6,398,489 B1 * 6/2002 Burdgick et al. ..... 415/115
2002/0077769 A1 * 6/2002 Ebinger ..... 702/150

* cited by examiner

*Primary Examiner*—I Cuda-Rosenbaum
(74) *Attorney, Agent, or Firm*—Nixon & Vanderhye

(57) ABSTRACT

A method of determining the throat area between adjacent airfoils in a nozzle set among a plurality of nozzle sets of a machine involves providing a plurality of inspection points on a suction side of a first airfoil and a pressure side of a second airfoil, the second airfoil being adjacent to the first airfoil. A plurality of inspection points are provided on each of an outer sidewall and an inner sidewall, respectively, of the nozzle set. Positions of each of the first and the second airfoils, and the outer and inner sidewalls are determined by measuring the positions of the inspection points. The measured positions of each of the first and second airfoils, and the outer sidewall and the inner sidewall are compared with corresponding predetermined values. A finite area deviation of each of the suction side of the first airfoil, the pressure side of the second airfoil, the outer sidewall, and the inner sidewall are determined, and the individual components are combined to compute a total finite area deviation. A total known throat area is adjusted to offset for the total finite area deviation in order to determine a net total throat area.

15 Claims, 7 Drawing Sheets

Straight TE Airfoil Throat
(Planar)

3D Airfoil Throat

3D Airfoil Throat

METHOD AND APPARATUS FOR ELECTRONICALLY DETERMINING NOZZLE THROAT AREA AND HARMONICS

FIELD OF THE INVENTION

This invention relates to gas turbines, and more particularly, it relates to a method for electronically determining the nozzle throat area and harmonic content of a nozzle set prior to assembly.

INCORPORATION BY REFERENCE

The following related commonly owned U.S. Patent is incorporated herein by reference in its entirety, including drawings:

Ostrowski et al.

U.S. Pat. No. 5,521,847

BACKGROUND AND SUMMARY OF THE INVENTION

In gas turbine design, it is desirable to achieve a proper nozzle throat area in the turbine section of the engine. The nozzle throat area for each turbine stage sets the pressure-ratio across that stage, the pressure-ratio would subsequently be turned into work by an airfoil (bucket). In order to obtain optimum turbine efficiency, it is crucial not only to achieve the designed target throat area, but also to accurately measure the throat area that will be used in the control system and the cycle deck for the engine. The inter-nozzle throat area is also crucial to bucket aeromechanics. Any variations in the throat area of a nozzle set could produce a forcing function as a function of blade harmonic frequency. This stimulus may cause vibratory stresses in the bucket that have not been accounted for, and may ultimately lead to engine failure.

With the use of three-dimensional (3D) bowed airfoil shapes in the hot section of a gas turbine engine, it is becoming increasingly difficult to calculate the physical throat area of the nozzle set, the physical throat area being defined as the internozzle segment area. The formulae that are typically used for throat area calculation are based on the assumption that the throat area is rectangular in nature, and two-dimensionally (2D) planar. Application of the 2D calculations to 3D airfoils produces significant errors due to the 3D nature of the throat of bowed airfoil shapes.

Because calculations are generally not successful or sufficiently accurate (until CMM came along to make it accurate and feasible), in the past it has been necessary to assemble the turbine engine and measure the physical throat area and the associated harmonics. It is time consuming to assemble the nozzles into the set (engine or retaining ring) and sequentially measure the area, and then evaluate the measured data to determine if the harmonic content produced by the engine is acceptable. Subsequently, if the harmonic content is found to be unacceptable, then the nozzle sets have to be disassembled, and the nozzles re-sorted to rectify or eliminate the harmonics. Also, when measuring the physical nozzle area, it is difficult to determine if the nozzle is positioned in an appropriate seating position. This process of reassembling the nozzle sets can lead to inaccuracies in throat area calculations. Further, given the nozzle assembly process, the nozzle may not load against the designed faces until the gas path pressure is applied.

In one approach, nozzles are loaded into an engine (or retaining ring) to obtain a physical measurement. This process may prove to be inaccurate based on how accurately the nozzles are loaded into the assembly. The accuracy of the process also depends on the accuracy of the physical measurements made by a technician. In prior approaches, variations were observed in the loading of the nozzle against the physical engine locating features because of the gas path pressure that will finally force nozzles into their proper engine position (designed axial, radial and tangential stops). Further compounding the above problem is the addition of new sealing techniques. For example, a nozzle may not load axially, until the engine gas path pressure forces the compression of a specific seal. Thus, even measuring the throat area after assembly may not yield accurate results.

Another problem with the current approach is that 3D bowed airfoils have a different throat area than the actual measured area observed by using a typical planar rectangular throat area calculation as shown below using Equation I.

$$\text{Area}=H^*[(0.25^*W_1)+(0.5^*W_2)+(0.25^*W_3)] \qquad \text{Equation I}$$

where

H=radial throat height $W_1$=throat width at 25% span (smallest distance at the trailing edge (TE))

$W_2$=throat width at 50% span $W_3$=throat width at 75% span

Further, the area calculation made using Equation I assumes that the trailing edge (throat) is relatively straight with no aft or tangential airflow bow. The measure of rectangular area when compared to the actual 3D area could be different by as much 10–20%.

The physical throat area is typically calculated based on a locus of points on the pressure side (PS-concave) trailing edge (TE) of one airfoil to the closest normal point on the adjacent airfoil suction side (SS-convex). This calculation creates the 3D developed throat area. The calculated area, however, may be different than the actual area that is book-kept in the cycle deck due to the differences in the 3D factor versus what the engine actually sees as the physical throat.

Accordingly, there is a need to improve the accuracy of throat area measurement for gas turbine nozzle sets. In addition, it is desirable to improve the cycle time in assembling the nozzle set, determining the throat area, and determining harmonic content of the nozzle set.

In one illustrative aspect of a preferred embodiment of the present invention, a coordinate measuring machine (CMM) may be used to measure each airfoil (and sidewall locations), while the nozzle is sitting on locators that represent the engine locators (or just inspecting the engine location points to determine where the rest of the nozzle is relative to these locating surfaces). A plurality of inspection points are located on each of the suction and pressure sides of airfoils, and also on the inner and outside wall locations in order to determine the deviations of the measured values with respect to predetermined values. The measurements obtained from the inspection points include a suction side (SS) component, a pressure side (PS) component, an outerside wall (OSW) component, and an inner sidewall (ISW) component. The number of inspection points used is merely exemplary, and they may be increased to increase the accuracy, and vice versa. After each nozzle set throat (inter-nozzle segment area) is measured at throat inspection points, the measurements obtained (deviations from predetermined/nominal values) from the inspection points are placed into an application program, such as, for example, a spreadsheet application, to calculate a finite area deviation with respect to each component of a nozzle set. The finite deviations of all the components (i.e., PS, SS, OSW, ISW components) are combined to produce a total finite area deviation. The total finite area deviation is offset (e.g., added or subtracted) from the predetermined throat area to determine a modified total throat area for the nozzle set. It should be noted that the predetermined/nominal throat values are known apriori for specific gas turbines.

Once the total throat area for each throat (e.g., inter-nozzle segment for each nozzle set) is determined, a determination is made to identify whether or not the total throat area is within predetermined values. If the total throat area is acceptable, then throat-to-throat variations are compared with reference values to identify harmonics. The reference values are determined and documented apriori, and are engine specific. If the harmonics are deemed to be acceptable, then the nozzle sets and the associated engine, such as, for example, a gas turbine, may be ready to be assembled. Otherwise, nozzles within a corresponding nozzle set are switched around until the harmonics are determined to be acceptable. This process may be iterated using a trial-and-error method, or may be performed using a software program written to iteratively sort the nozzle sets.

In one aspect, a method of determining the throat area between adjacent airfoils in a nozzle set among a plurality of nozzle sets of a machine, the method comprising (a) providing a plurality of inspection points on a suction side of a first airfoil and a pressure side of a second airfoil, the second airfoil being adjacent to the first airfoil; (b) providing a plurality inspection points on each of an outer sidewall and an inner sidewall, respectively, of the nozzle set; (c) determining the position of each the first and second airfoils, and the outer and inner sidewalls by measuring the positions of the inspection points; (d) comparing the measured positions of each of the first and second airfoils, and the outer sidewall and the inner sidewall, with corresponding predetermined values; (e) determining a finite area deviation of each of the suction side of the first airfoil, the pressure side of the second airfoil, the outer sidewall, and the inner sidewall, all from the comparison step (d); (f) combining the finite area deviations as in step(e) to determine a total finite area deviation; and (g) adjusting a total known throat area to offset for the total finite area deviation to determine a net total throat area. The method further comprising: (h) determining if the net total throat area is within predetermined values; (i) replacing the nozzle set if the net total throat area is not within predetermined values; (j) iterating steps (a)–(h) for other nozzle sets of the gas turbine; (k) comparing the net total throat area of a nozzle set with the net total throat area of an adjacent nozzle set to determine throat-to-throat variations (harmonics); (l) comparing the measured harmonics with predetermined harmonic values; (m) assembling the gas turbine if the measured harmonics are within predetermined harmonic values; (n) switching the nozzle sets if the measured harmonics are not within the predetermined harmonic values; (o) repeating the switching step(n) until the measured harmonics are observed to be within predetermined harmonic values; (p) assembling the machine if the measured harmonics are determined to be within predetermined harmonic values. Preferably, each inspection point on the airfoil is counted as $1/5^{th}$ of the total three-dimensional (3D) radial throat height. Each inspection point on each of said outer sidewall and inner sidewall, respectively are counted as ½ of the width between the suction side and the pressure side. The positions of the inspection points are determined using a coordinate measuring machine (CMM).

In another aspect, a method of determining the inter-nozzle segment area of adjacent airfoils of a gas turbine nozzle set, the gas turbine comprising a plurality of nozzle sets, the method comprising a) measuring the positions of the airfoils, an outer sidewall and an inner sidewall, by providing a plurality of inspection points on each of the airfoils, the outer sidewall and the inner sidewall; b) calculating a finite area deviation of each the inspection point with respect to corresponding predetermined values; c) combining the finite area deviations to determine a total finite area deviation; and d) determining a net total inter-nozzle segment area by adjusting a predetermined inter-nozzle segment area with the total finite area deviation of step(c). The method further comprising e) determining harmonics if the net total inter-nozzle segment area is within predetermined values; f) assembling the gas turbine if the harmonics are within predetermined limits; g) switching nozzle sets of the gas turbine if the harmonics are not within predetermined limits; and h) iterating the switching step until the harmonics are determined to be within predetermined limits.

In yet another aspect, an apparatus for measuring the throat area between adjacent airfoils in a nozzle set among a plurality of nozzle sets of a gas turbine, comprising: means for measuring the positions of the airfoils, an outer sidewall and an inner sidewall, by providing a plurality of inspection points on each of the airfoils, the outer sidewall and the inner sidewall; means for calculating a finite area deviation of each inspection point with respect to corresponding predetermined values; means for combining the finite area deviations to determine a total finite area deviation; and means for determining a net total inter-nozzle segment area by adjusting a predetermined inter-nozzle segment area with the total finite area deviation. The apparatus further comprises means for determining harmonics if the net total inter-nozzle segment area is within predetermined values; means for assembling the gas turbine if the harmonics are within predetermined limits; means for switching nozzle sets of the gas turbine if the harmonics are not within predetermined limits; and means for iterating the switching step until the harmonics are determined to be within predetermined limits.

DETAILED DESCRIPTION OF THE INVENTION

Figure 1:
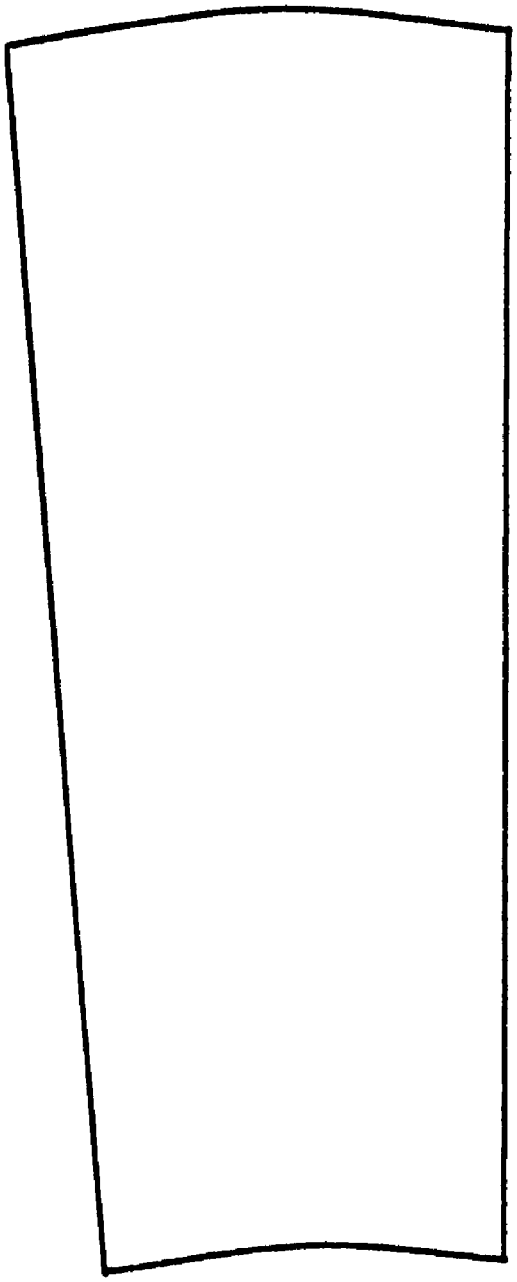
FIG. 1 shows a planar view of a straight trailing edge (TE) airfoil throat.
Figure 2:
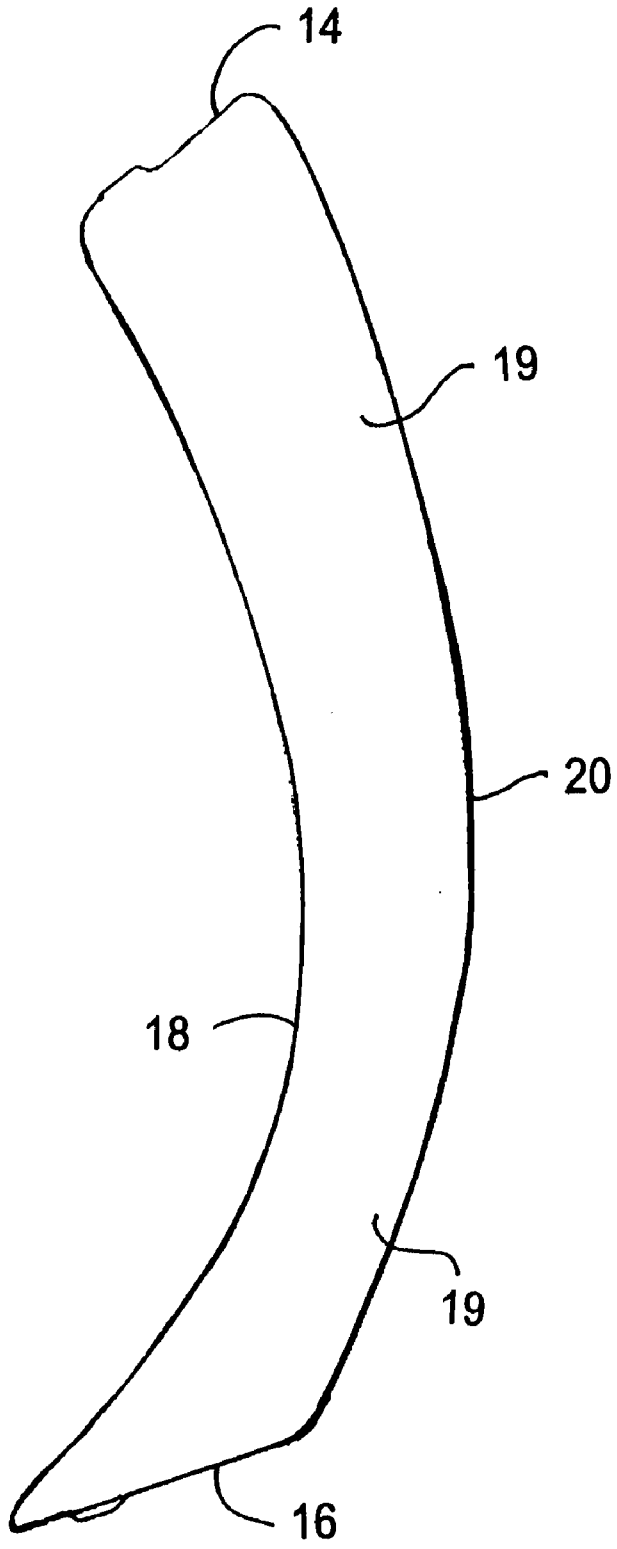
FIG. 2 shows a planar view of a 3D airfoil throat.
Figure 3:
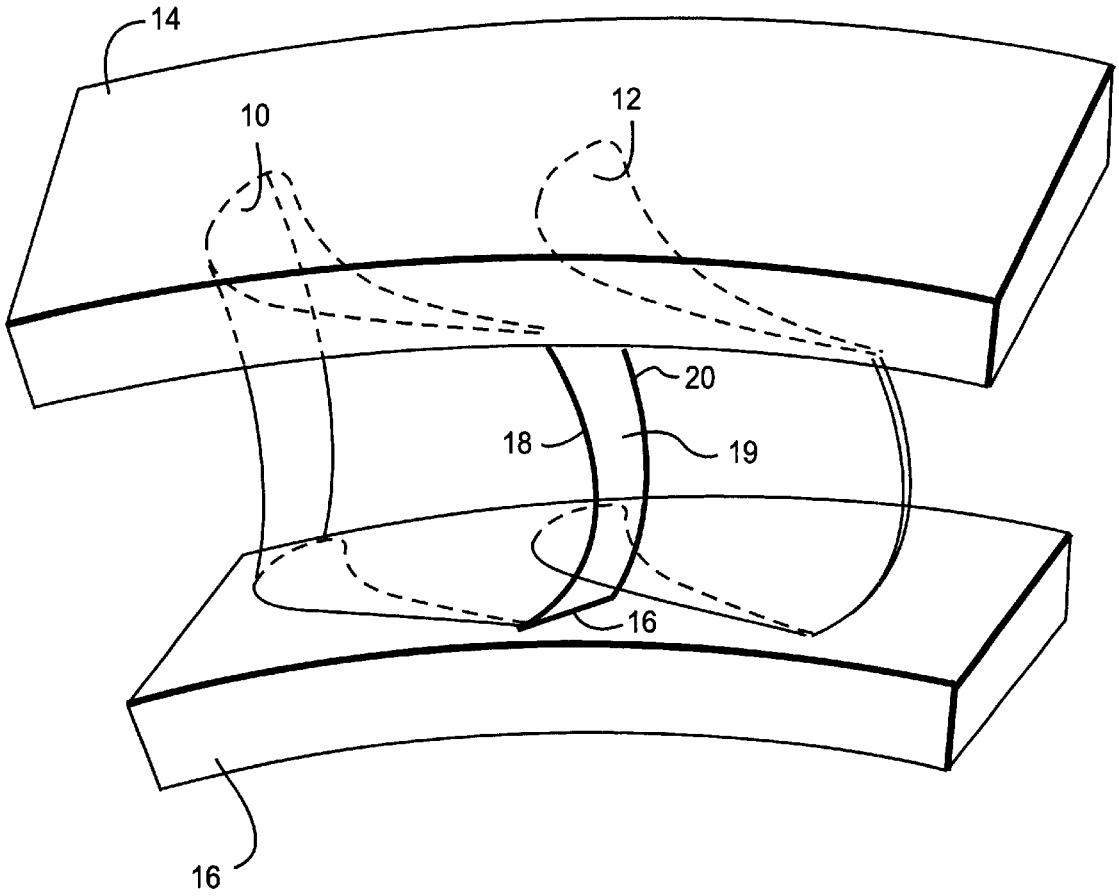
FIG. 3 shows an exemplary view of a 3D airfoil throat viewing from a direction of aft looking forward.
Figure 4:
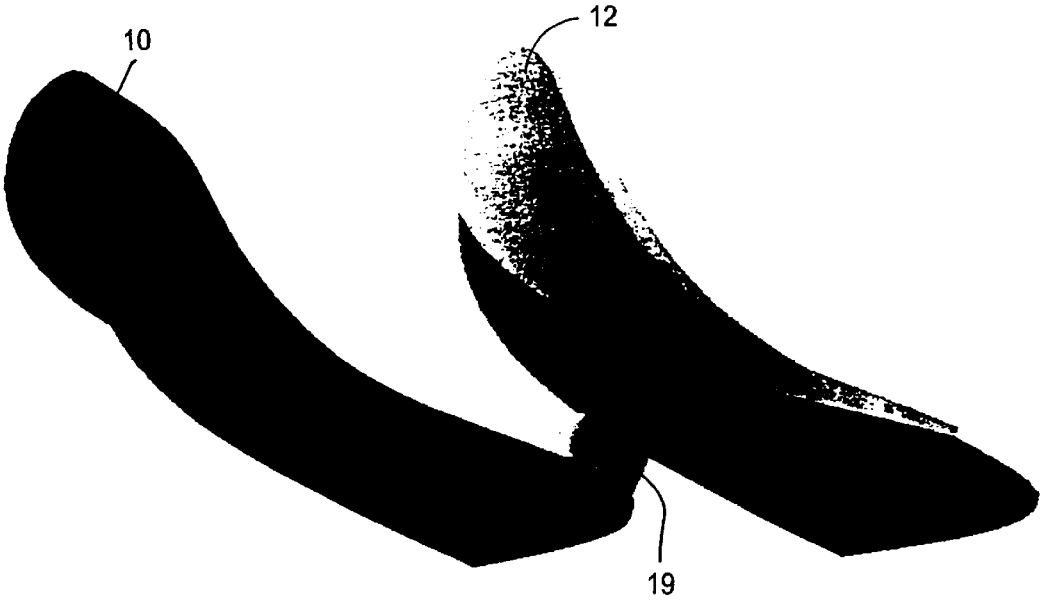
FIG. 4 shows a 3D view of an airfoil throat.
Figure 4:
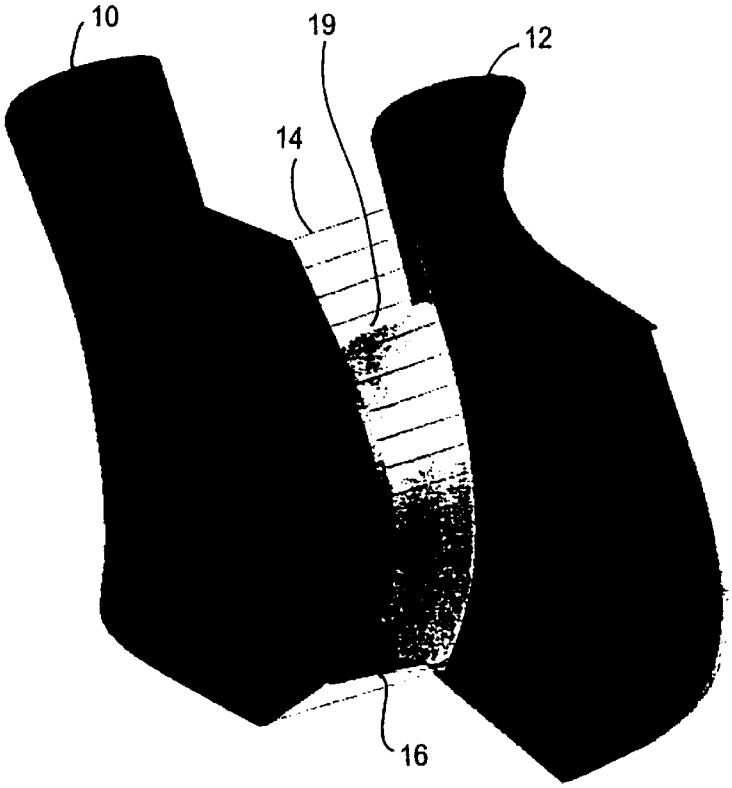

FIG. 1 shows a planar view of a straight TE airfoil throat. FIG. 2 shows a planar view of a 3D airfoil throat having a suction side(SS) component 18 of airfoil 10 (FIG. 3), a pressure side(PS) component 20 of airfoil 12, and sidewall segments 14, 16, respectively. FIG. 3 shows an exemplary view of a 3D airfoil throat as shown in Figure and viewing from a direction of aft looking forward. FIG. 4 shows a 3D view of the airfoil throat as in FIGS. 2 and 3.

Figure 5:
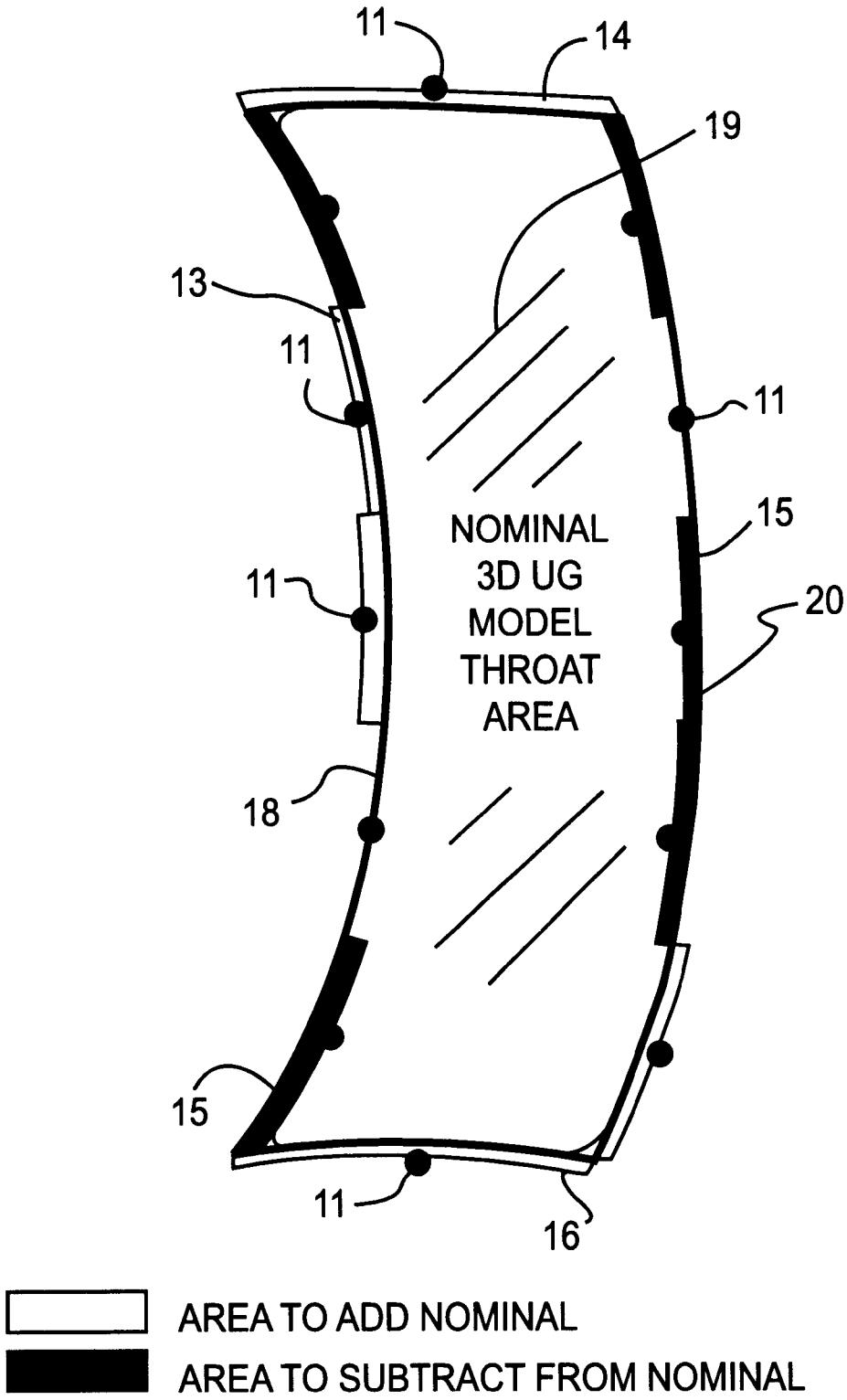
FIG. 5 illustrates an exemplary positioning of inspection points on two adjacent airfoils.

Referring to FIG. 5, there is shown an exemplary illustration of positioning typical inspection points 11 on the SS and PS surfaces 18, 20, respectively, of two adjacent airfoils 10, 12 (FIG. 3). It will be appreciated that several of such airfoils may be present in a typical gas turbine engine. Inspection points 11 are also located on the outer and inner sidewalls 14, 16, respectively of the throat (inter-nozzle segment area). A coordinate measuring machine (CMM) is used to measure the location of airfoils 10, 12 as well as outer and inner sidewalls 14, 16, respectively. The number of inspection points used for obtaining measurements is merely exemplary, and the number of points is directly proportional to the accuracy of the measurements. After each nozzle is inspected at the throat inspection points, the position of the airfoils 10, 12 is measured, and a finite area deviation of the airfoils from predetermined values is calculated at each inspection point, for example, using a spreadsheet application program. The finite area deviations are used to determine a positive area as indicated at 13, and negative area as indicated at 15. the positive and negative areas are used to adjust the nozzle throat area 19. The combined finite area deviation is calculated by combining the finite area deviation measured from each of the SS 18, the PS 20, the OSW 14, and ISW 16. The area occupied by the inspection points 11 is compensated by accounting for each inspection point on the suction and pressure sides of the airfoils 10, 12 as $1/5^{th}$ of the total 3D radial throat height, and each inspection point disposed at OSW 14, and ISW 16 as ½ of the width between the suction side and pressure side of the airfoils 10, 12.

The 3D airfoil throat area is calculated according to Equation 2 as below:

$$\frac{\text{3D BOWED AIRFOIL THROAT AREA CALCULATION}}{\text{Inter-nozzle area deviation from nominal}} = \sum_{i=1}^{2}(Oi*WO/2)+\sum_{i=1}^{2}(Li*WI/2)+\sum_{i=1}^{5}(PSRi*HP/5)+\sum_{i=1}^{5}(SSRi*HP/5) \quad \text{Equation 2}$$

Where:

HP=PS radial throat height (3D linear spline length)

HS=SS radial throat height (3D linear spline length)

WO=OSW throat width (length prior to adding fillets)

WI=ISW throat width (length prior to adding fillets)

O1, O2=OSW and ISW inspection point stock condition for each corresponding pt.

I1, I1=OSW and ISW inspection point stock condition for each corresponding pt.

PSR1, PSR2 . . . PSR5=Pressure side inspection point stock condition for each corresponding pt.

SSR1, SSR2 . . . SSR5=Suction side inspection point condition for each corresponding pt.

The combined finite area deviations for the set are added or subtracted from the nominal Solid Model throat area to determine the total calculated throat area for a nozzle throat.

Figure 6:
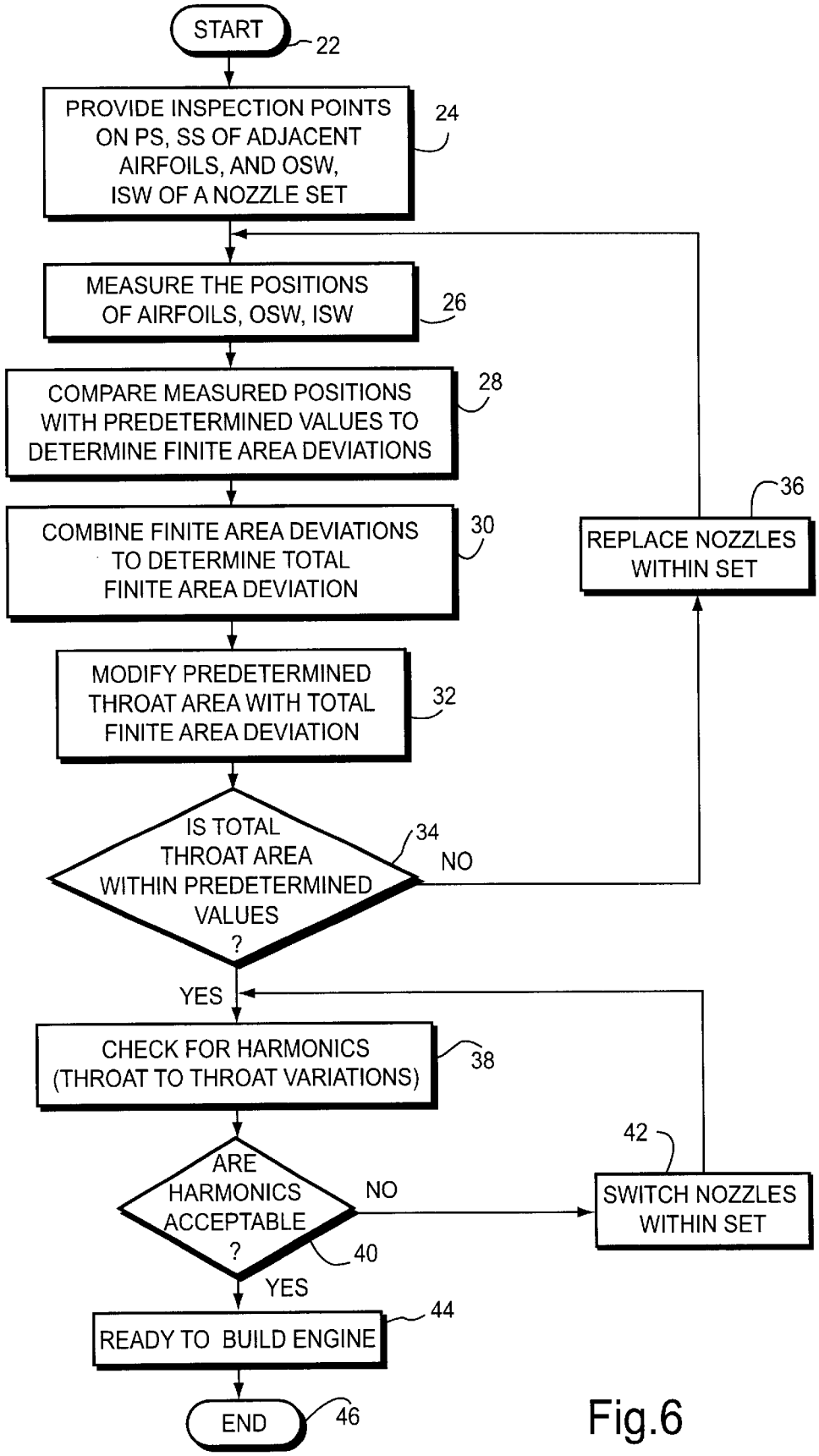
FIG. 6 shows an exemplary flow chart for calculating the 3D bowed airfoil throat.

FIG. 6 shows an exemplary flow chart for calculating the 3D bowed airfoil throat. The predetermined inter-nozzle throat area is determined apriori, the throat area being specific for a particular gas turbine. A plurality of inspection points are provided on the airfoils 10, 12, and OSW 14, and ISW 16 of a nozzle set for making measurements as described with respect to FIG. 5. This process is generally indicated at step 24. The finite area deviation of an individual nozzle stock condition (i e., the finite area deviation of the components from the pressure side, the suction side of airfoils 10, 12, and the sidewall locations OSW 14 and ISW 16 at the throat) is determined as in FIG. 5, and is generally indicated at step 28. The finite area deviations measured by the inspection points 11 on the SS, PS, OSW, ISW (FIG. 5) are combined in step 30 to determine total finite area deviation. The total finite area deviation is added/subtracted from the predetermined throat area to arrive at a net total throat area at step 32. A comparison is made between the net total throat area and the predetermined throat area at step 34. If the net total throat area is outside of the predetermined values, then the nozzles within the subject nozzle set are replaced as indicated at step 36, and the process of calculating the total throat area is repeated until the net throat area is determined to be within predetermined values.

Figure 7:
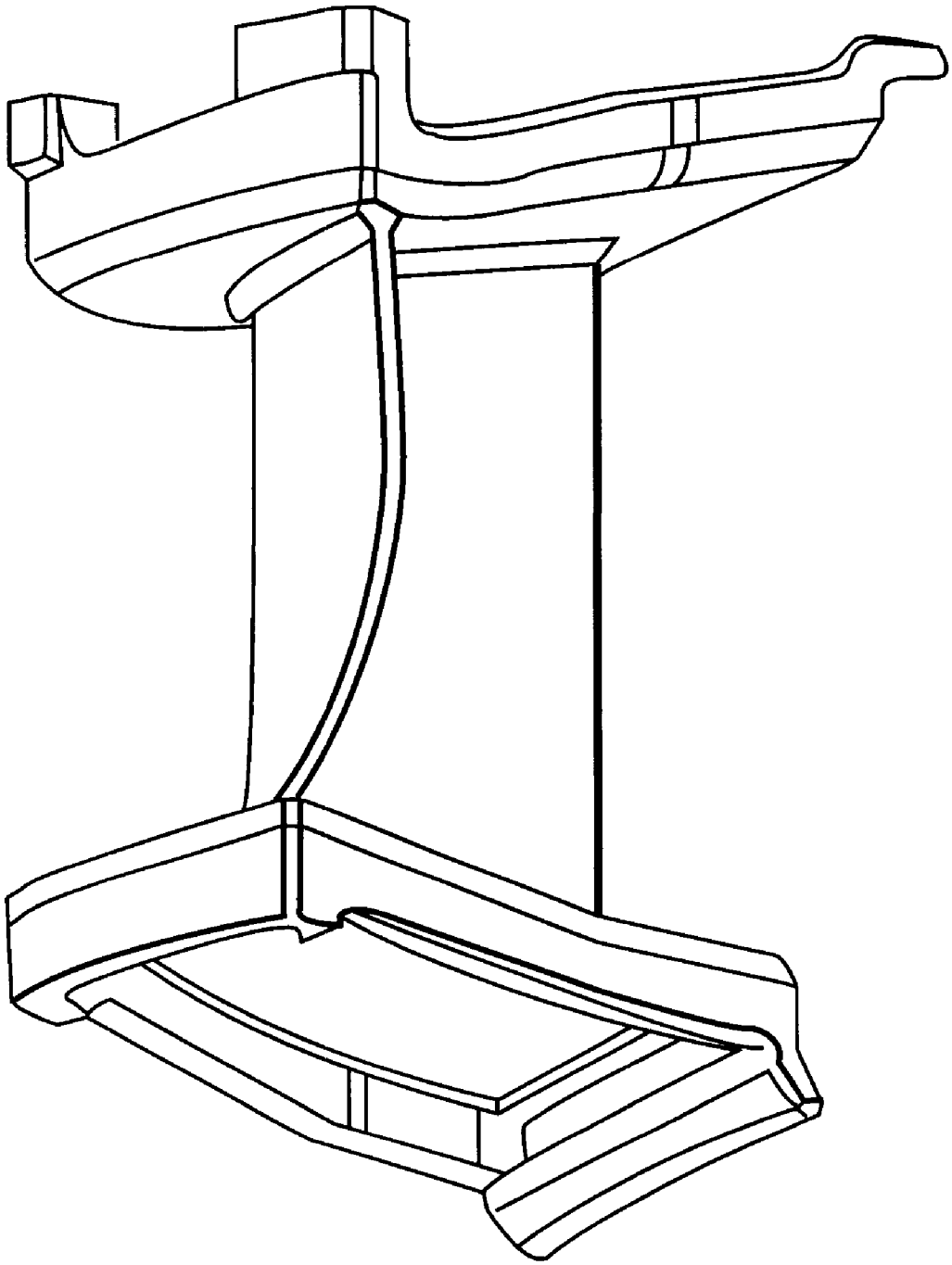
FIG. 7 shows a rear view of a 3D bowed airfoil.

On the other hand, if the net total throat area is determined to be within predetermined values, then throat-to-throat variations (harmonics) are determined as indicated at step 38. If the harmonics are determined to be within predetermined values, and therefore acceptable as shown at step 40, then the nozzle sets and the associated gas turbine are ready to be assembled at step 44. However, if the harmonics are not acceptable, then nozzles within a corresponding nozzle set are switched at step 42, and the process of determining harmonics as indicated at step 40 is iterated until the harmonics are determined to be within predetermined values. The predetermined values of harmonics are documented in design practice, and are specific to each engine, as each engine is presumed to have specific nozzle and airfoil count. The iterative process of switching the nozzles to arrive at acceptable harmonic levels may be performed using a trial-and-error method as noted above. It may also be performed by a software driven program that would randomly sort the nozzle sets. FIG. 7 generally shows a rear view of a 3D bowed airfoil.

Although the present invention may be used in connection with 3D bowed airfoil shapes, it will be appreciated that it should not be construed to be limited to bowed airfoils. The present invention improves the accuracy in build time of mature engine nozzle sets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of determining the throat area between adjacent airfoils in a nozzle set among a plurality of nozzle sets of a machine, the method comprising:

(a) providing a plurality of inspection points on a suction side of a first airfoil and a pressure side of a second airfoil, said second airfoil being adjacent to said first airfoil;

(b) providing a plurality of inspection points on each of an outer sidewall and an inner sidewall, respectively, of the nozzle set;

(c) determining the position of each said first and second airfoils, and said outer and inner sidewalls by measuring the positions of said inspection points;

(d) comparing the measured positions of each of the first and second airfoils, and said outer sidewall and said inner sidewall, with corresponding predetermined values;

(e) determining a finite area deviation of each of the suction side of the first airfoil, the pressure side of the second airfoil, the outer sidewall, and the inner sidewall, all from the comparison step (d);

(f) combining the finite area deviations as in step (e) to determine a total finite area deviation; and (g) adjusting a total known throat area to offset for the total finite area deviation to determine a net total throat area.

2. The method of claim 1, further comprising:

(h) determining if the net total throat area is within predetermined values;

(i) replacing nozzles within the nozzle set if the net total throat area is not within predetermined values;

(j) iterating steps (a)–(h) for other nozzle sets of the gas turbine;

(k) comparing the net total throat area of a nozzle set with the net total throat area of an adjacent nozzle set to determine throat-to-throat (harmonics;

(l) comparing the measured harmonics with predetermined harmonic values;

(m) assembling the gas turbine if the measured harmonics are within predetermined harmonic values;

(n) switching nozzles within a nozzle set if the measured harmonics are not within said predetermined harmonic values;

(o) repeating the switching step (n) until the measured harmonics are observed to be within predetermined harmonic values;

(p) assembling the machine if the measured harmonics are determined to be within predetermined harmonic values.

3. The method of claim 1, wherein each inspection point on the airfoil is counted as $1/5^{th}$ of the total three-dimensional radial throat height.

4. The method of claim 1, wherein each inspection point on each of said outer sidewall and inner sidewall, respectively are counted as ½ of the width between the suction side and the pressure side.

5. The method of claim 1, wherein the positions of said inspection points are determined using a coordinate measuring machine (CMM).

6. A method of determining the inter-nozzle segment area of adjacent airfoils of a gas turbine nozzle set, the gas turbine comprising a plurality of nozzle sets, the method comprising:

a) measuring the positions of the airfoils, an outer sidewall and an inner sidewall, by providing a plurality of inspection points on each of the airfoils, the outer sidewall and the inner sidewall;

b) calculating a finite area deviation of each said inspection point with respect to corresponding predetermined values;

c) combining the finite area deviations to determine a total finite area deviation; and d) determining a net total inter-nozzle segment area by adjusting a predetermined inter-nozzle segment area with the total finite area deviation of step(c).

7. The method of claim 6, further comprising:

e) determining harmonics if the net total inter-nozzle segment area is within predetermined values;

f) assembling the gas turbine if the harmonics are within predetermined limits;

g) switching nozzles within respective nozzle sets of the gas turbine if the harmonics are not within predetermined limits; and h) iterating the switching step until the harmonics are determined to be within predetermined limits.

8. The method of claim 7, wherein said finite deviation of each inspection point from a predetermined reference value is determined using a coordinate measuring machine.

9. The method of claim 7, wherein each inspection point on the airfoil is counted as $1/5^{th}$ of the total three-dimensional radial throat height.

10. The method of claim 7, wherein each inspection point on each of said outer sidewall and inner sidewall, respectively are counted as of the width between the suction side and the pressure side.

11. An apparatus for measuring the throat area between adjacent airfoils in a nozzle set among a plurality of nozzle sets of a gas turbine, comprising:

means for measuring the positions of the adjacent airfoils, an outer sidewall and an inner sidewall, by providing a plurality of inspection points on each of the airfoils, the outer sidewall and the inner sidewall;

means for calculating a finite area deviation of each said inspection point with respect to corresponding predetermined values;

means for combining the finite area deviations to determine a total finite area deviation; and means for determining a net total inter-nozzle segment area by adjusting a predetermined inter-nozzle segment area with the total finite area deviation.

12. The apparatus of claim 11, further comprises:

means for determining harmonics if the net total inter-nozzle segment area is within predetermined values;

means for assembling the gas turbine if the harmonics are within predetermined limits;

means for switching nozzles within respective nozzle sets of the gas turbine if the harmonics are not within predetermined limits; and means for iterating the switching step until the harmonics are determined to be within predetermined limits.

13. The apparatus of claim 11, wherein the positions of the airfoils are measured by a coordinate measuring machine.

14. The apparatus of claim 13, wherein inspection point on each said airfoil is counted as $1/5^{th}$ of the total three-dimensional radial throat height.

15. The apparatus of claim 13, wherein each inspection point on each of said outer sidewall and inner sidewall, respectively, are counted as ½ of the width between a suction side and a pressure side of said adjacent airfoils.

* * * * *

UNITED STATES PATENT AND TRADEMARK OFFICE

CERTIFICATE OF CORRECTION

PATENT NO. : 6,604,285 B2
DATED : August 12, 2003
INVENTOR(S) : Steven S. Burdgick It is certified that error appears in the above-identified patent and that said Letters Patent is hereby corrected as shown below:

Column 7,
Line 18, delete “(harmonics” and insert -- harmonics -- therefor.

Column 8,
Line 20, insert -- 1/2 -- before “of the width”.

Signed and Sealed this

Twenty-eighth Day of October, 2003

JAMES E. ROGAN
*Director of the United States Patent and Trademark Office*